US006407049B1

(12) United States Patent
Willey et al.

(10) Patent No.: US 6,407,049 B1
(45) **Date of Patent: *Jun. 18, 2002**

(54) PHOTOCHEMICAL SINGLET OXYGEN GENERATORS HAVING CATIONIC SUBSTANTIVITY MODIFIERS

(75) Inventors: Alan David Willey, Cincinnati, OH (US); Brian Jeffreys, Grimbergen; David William Ingram, Woluwe Saint-Lambergt, both of (BE)

(73) Assignee: Case Western Reserve University, Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/355,078

(22) PCT Filed: Jan. 22, 1998

(86) PCT No.: PCT/US98/00228

§ 371 (c)(1),
(2), (4) Date: Jul. 23, 1999

(87) PCT Pub. No.: WO98/32828

PCT Pub. Date: Jul. 30, 1998

Related U.S. Application Data

(60) Provisional application No. 60/035,902, filed on Jan. 24, 1997.

(51) Int. Cl.[7] ..... C11D 3/00
(52) U.S. Cl. ..... 510/301
(58) Field of Search ..... 510/301

(56) References Cited

U.S. PATENT DOCUMENTS

| | | | | |
|---|---|---|---|---|
| 3,094,536 A | | 6/1963 | Kenney et al. | 260/314.5 |
| 3,927,697 A | | 12/1975 | Speakman | 8/103 |
| 4,033,718 A | | 7/1977 | Holcombe et al. | 8/103 |
| 4,166,718 A | | 9/1979 | Reinert et al. | 8/111 |
| 4,240,920 A | | 12/1980 | de Luque | 252/99 |
| 4,255,273 A | | 3/1981 | Sakkab | 252/102 |
| 4,256,597 A | | 3/1981 | Sakkab | 252/99 |
| 4,318,883 A | | 3/1982 | Polony et al. | 422/22 |
| 4,368,053 A | | 1/1983 | Eckhardt et al. | 8/102 |
| 4,400,173 A | * | 8/1983 | Beavan | 8/107 |
| 4,497,741 A | | 2/1985 | Hölzle et al. | 260/245.77 |
| 4,648,992 A | | 3/1987 | Graf et al. | 540/124 |
| 5,916,481 A | * | 6/1999 | Wiley | 252/186.21 |

FOREIGN PATENT DOCUMENTS

| | | |
|---|---|---|
| EP | 0 285965 | 10/1988 |
| EP | 0 381211 | 8/1990 |
| EP | 0 484027 | 5/1992 |
| GB | 1372035 | 10/1974 |
| GB | 1408144 | 1/1975 |
| GB | 2159516 | 12/1985 |
| JP | 6-73397 | 3/1994 |
| WO | WO 91/18006 | 11/1991 |

OTHER PUBLICATIONS

Brasseur, N., et al., "Synthesis and Photodynamic Activities of Silicon 2,3–Naphthalocyanine Derivatives", J. Med. Chem., vol. 37, p. 415–420 (1994).

Cook, M.J. et al., "Octa–alkoxy Phthalocyanine and Naphthalocyanine Dertivatives: Dyes with Q–band Absorption in the Far Red of Near Infrared" J. Chem. Soc., Perkin Trans., vol. 1., p. 2453–2458 (1998).

Esposito, J.N. et al. "The Synthesis and Physical Properties of Some Organo–and Organosiloxysilicon Phthalocyanines", Inorg. Chem., vol. 5, No. 11, pp. 1979–1984 (Nov. 1966).

Ford, W.E. et al., "Synthesis and Photochemical Properties of Aluminum, Gallium, Silicon, and Tin Naphthalocyanines", Inorg. Chem., vol. 31, p. 3371–3377 (1992).

Hayashida, S., et al., "Effect of Axial Substituents on the Aggregate of Silicon Naphthalocyanine in the Vacuum Deposited Thin Films", Chem. Lett., pp. 2137–2140 (1990).

Joyner, R.D. et al, "Phthalocyaninosilicon Compounds", Inorg. Chem., vol. 1, No. 2, pp. 236–238 (May 1962).

Kroenke, W.E. et al., "The Infrared Spectra of Some Tin and Lead Phthalocyanines", Inort. Chem., vol. 3, No. 5, pp. 696–698 (May 1964).

Lowery, M.H. et al., "Dichloro(phthalocyanino)silicon", Inorg. Chem., vol. 4, p. 128 (1965).

Moyer, T. J., et al., "Iodine Doped $(SiNco)_n$—A New Conducting Polymer", Polymer Preps, vol. 25, p. 234–235 (1986).

Rafaeloff, R., et al., "New Group IV Phthalocyanines", J. Inorg. Nucl. Chem., vol. 28, pp. 899–902 (1996).

Wen, T–C., et al., "Synthesis and Photoproperties of Silicon Phthalocyanines and Silicon Naphthalocyanines", J. Chin. Chem, Soc., vol. 40, pp. 141–147 (1993).

Wheeler, B.L. et al., "A Silicon Phthalocyanine and a Silicon Naphthalocyanine; Synthesis, Electrochemistry, and Electrogenerated Chemiluminescence" J. Am. Chem. Soc., vol. 106, p. 7404–7410 (1984).

Witkiewic, Z. et al., "Properties of Octamethoxyphthalocyanines I. On their syntheses, electrical conductivity, and catalytic activity", Material Scinece, vol. 11, No. 1–2, pp. 39–45 (1976).

* cited by examiner

*Primary Examiner*—John Hardee
(74) *Attorney, Agent, or Firm*—Fay, Sharpe, Fagan, Minnich & McKee, LLP

(57) ABSTRACT

The present invention relates to photochemical singlet oxygen generators having enhanced fabric substantivity, said photochemical singlet oxygen generators useful as photobleaches in laundry detergent compositions. the present invention is also directed to methods for removing stains on fabric by contacting dirty and stained fabric with the photobleaching agents described herein.

16 Claims, No Drawings

PHOTOCHEMICAL SINGLET OXYGEN GENERATORS HAVING CATIONIC SUBSTANTIVITY MODIFIERS

This application is a 371 of PCT/US98/00228 filed Jan. 22, 1998 which claims benefit of Pov. No. 60/035,902 filed Jan. 24, 1997.

FIELD OF THE INVENTION

The present invention relates to photochemical singlet oxygen generators having a cationic axial substituent which enhances the substantivity of said singlet oxygen generators for fabric surfaces. The photochemical singlet oxygen generators described herein are useful in laundry detergent compositions as bleaching agents. The present invention also relates to methods for bleaching fabrics with the photochemical singlet oxygen generators.

BACKGROUND OF THE INVENTION

It is known that certain water soluble phthalocyanine, naphthalocyanine, mixed cyanine and metallocyanine compounds can be used as photobleaching and anti-microbial agents. Phthalocyanines, naphthalocyanine, mixed cyanine and metallocyanines can form "singlet oxygen".

Singlet oxygen can be formed by chemical as well as photochemical processes. Singlet oxygen is a highly oxidative species capable of reacting with substances, for example, with stains on a fabric to bleach them to a colorless and usually water-soluble state. There are many examples of phthalocyanines and naphthalocyanines photobleaches, the most common being the zinc and aluminum phthalocyanines. In the literature the term "photosensitizer" is often used instead of "photoactivator" and may therefore be considered as standing equally well for the latter term used throughout this specification.

The prior art teaches phthalocyanine and naphthalocyanine compounds having the general structure

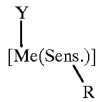

where Me is a transition or non-transition metal (Sens.) is a phthalocyanine or naphthalocyanine ring which, when combined with a suitable Me unit, is capable of undergoing photosensitization of oxygen molecules, R units are substituent groups which are bonded to the photosensitization ring units (Sens.) to enhance the solubility or photochemical properties of the molecule, and Y units are substituents associated with the metal atom, for example, anions to provide electronic neutrality.

It has been a task of formulators of photobleaches to modify the properties of the (Sens.) unit of the molecule to increase the quantum efficiency without reducing the water solubility. Typically this has been accomplished by substitution on the photochemical (Sens.) ring. However, substitution on the macrocyclic ring is frequently difficult and can adversely affect other photobleach properties such as color, substantivity and photoefficiency.

Surprisingly, it has been found that the compounds of the present invention allow formulators to increase the photoefficiency of the singlet oxygen generators without adversely affecting the other parameters of the molecule. In addition, the substantivity of the photochemical singlet oxygen generator for fabric surface can be modified without producing an undesired effect in the photophysics of the molecule. This ability to delineate and selectively modify these key structural elements contributing to the target properties of the molecule allows the formulator to proceed without having to rely upon a "hit and miss" stratagem.

The present invention provides a means by which an effective photosensitizer can be made to have an enhanced affinity for the surface of fabric, especially cotton fabric. This task is achieved by attaching an axial cationic moiety to the singlet oxygen generator. This axial cationic moiety is capable of interacting with various surfaces, especially fabric surfaces which can contain a negative charge. By this interaction, the cationic group draws the photoactive singlet oxygen producing portion of the molecule into proximity with the surface of the fabric where the bleaching action of the photosensitizer can take place on stains.

It is therefore an object of the present invention to provide photochemical singlet oxygen generators which serve as photobleaches and which have a higher efficiency for cleaning stains on fabric. It is a further object of the present invention to provide photobleaching compositions suitable for use as laundry detergent bleaching compositions.

It is a yet further object of the present invention to provide enhanced photobleaching hard surface cleaning compositions for non-porous hard surfaces, inter alia, Formica®, ceramic tile, glass, or for porous hard surfaces such as concrete or wood.

It is a still further object of the present invention is to provide a method for bleaching fabric with laundry compositions comprising the photobleaching compounds of the present invention.

It is yet still a further object of the present invention is to provide a method for cleaning hard surfaces with the photobleaching compounds of the present invention.

BACKGROUND ART

Various patent documents relate, to photochemical bleaching or to the use of cyanine compounds as well as their formulation and synthesis. See for example U.S. Pat. No. 3,094,536 issued Jun. 18, 1963; U.S. Pat. No. 3,927,967 issued Dec. 23, 1975; U.S. Pat. No. 4,033,718 issued Jul. 5, 1977; U.S. Pat. No. 4,166,718 issued Sep. 4, 1979; U.S. Pat. No. 4,240,920 issued Dec. 23, 1980; U.S. Pat. No. 4,255,273 issued Mar. 10, 1981; U.S. Pat. No. 4,256,597 issued Mar. 17, 1981; U.S. Pat. No. 4,318,883 issued Mar. 9, 1982; U.S. Pat. No. 4,368,053 issued Jan. 11, 1983; U.S. Pat. No. 4,497,741 issued Feb. 5, 1985; U.S. Pat. No. 4,648,992 issued Mar. 10, 1987; and U.K. Pat. App. 1,372,035 published Oct. 30, 1974; U.K Pat. App. 1,408,144 published Oct. 1, 1975; U.K. Pat App. 2,159,516 published Dec. 4, 1985; E.P. 285,965 A2; E.P. 381,211 A2 published Aug. 8, 1990; E.P. 484,027 A1 published May 6, 1992; WO 91/18006 published Nov. 28, 1991 and Japanese Kokai 06-73397 Derwent Abst. No. (94-128933) published Mar. 15, 1994.

In addition to the above cited patent publications, other references describing the synthesis, preparation and properties of cyanines, incorporated herein also by reference; *Phthalocyanines: Properties and Applications*, Leznoff, C. C. and Lever A. B. P. (Eds), VCH, 1989; *infrared Absorbing Dyes*, Matsuoka, M. (Ed), Plenum, 1990; *Inorg. Chem.*, Lowery, M. J. et at., 4, pg. 128, (1965); *Inorg. Chem.* Joyner R. D. et al., 1, pg. 236, (1962); *Inorg. Chem.*, Kroenke, W. E. et al., 3, 696, 1964; *Inorg. Chem.* Esposito, J. N. et al., 5, pg.1979, (1966); *J. Am. Chem. Soc.* Wheeler, B. L. et al., 106, pg. 7404, (1984); *Inorg. Chem.* Ford, W. E, et al., 31, pg. 3371, (1992); *Material Science*, Witkiewicz, Z. et al., 11, pg. 39, (1978); *J. Chem. Soc.* Perkin Trans. I, Cook, M. J., et al., pg. 2453, (1988); *J. Chin Chem. Soc.*, 40, pg. 141, (1993); *J. Inorg. Nucl. Chem.*, 28, pg. 899, (1966); *Polymer Preps*, 25, pg. 234, (1986); *Chem. Lett.*, 2137, (1990); *J. Med. Chem.*, 37, pg. 415, (1994).

SUMMARY OF THE INVENTION

The present invention relates to singlet oxygen generators useful as a bleaching agent in laundry detergent compositions, said singlet oxygen generators having the formula:

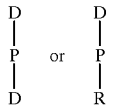

wherein P is a photosensitizer unit; R is an axial moiety which mediates the solubility of the singlet oxygen generator; and D is a unit which increases the fabric substantivity of the singlet oxygen generator, said unit having the formula:

$$—L^1—E \text{ or } —L^1—B—[L^2—E]_m$$

wherein E is a unit which comprises a tetravalent nitrogen having the formula:

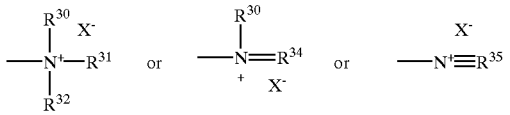

wherein each $R^{30}$–$R^{35}$ is linear and branched $C_1$–$C_{22}$ alkyl, linear and branched $C_1$–$C_{22}$ alkenyl, substituted and unsubstituted aryl, substituted and unsubstituted alkylenearyl, substituted and unsubstituted aryloxy, substituted and unsubstituted alkyleneoxyaryl, substituted and unsubstituted oxyalkylenearyl, alkyleneoxyalkyl, or any $R^{30}$–$R^{35}$ can be taken together to form a nitrogen-containing ring, and mixtures thereof; X is a water soluble anion; B is a branching unit having the formula:

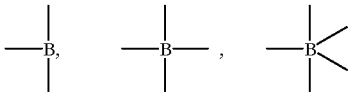

wherein B is selected from the group consisting of boron, aluminum, nitrogen, phosphorous, carbon, silicon, tin, germanium, and mixtures thereof, preferably carbon or silicon; and $L^1$ and $L^2$ are linking units, provided said linking units when taken together with said B unit comprise a total of at least 2 continuous covalent bonds from said P unit to said E units; m is from 2 to 4.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to photochemical singlet oxygen generators which have an enhanced substantivity for fabric surfaces. This increase in fabric substantivity is due to the cationic nature of the axial D units which are substituted on the photosensitizer unit.

The present invention also relates to cleaning compositions which comprise the photochemical singlet oxygen generators of the present invention. Laundry detergent compositions according to the present invention comprise:

a) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a singlet oxygen generator having the

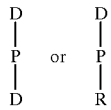

wherein P is a photosensitizer unit; R is an axial moiety which mediates the solubility or substantivity of the singlet oxygen generator; and D is a unit which increases the fabric substantivity of the singlet oxygen generator, said unit having the formula $$—L^1—E \text{ or } —L^1—B—[L^2—E]_m$$

wherein E is a unit which comprises a tetravalent nitrogen having the formula:

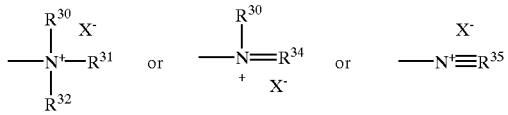

wherein each $R^{30}$–$R^{35}$ is linear and branched $C_1$–$C_{22}$ alkyl, linear and branched $C_1$–$C_{22}$ alkenyl, substituted and unsubstituted aryl, substituted and unsubstituted alkylenearyl, substituted and unsubstituted aryloxy, substituted and unsubstituted alkyleneoxyaryl, substituted and unsubstituted oxyalkylenearyl, alkyleneoxyalkyl, or any $R^{30}$–$R^{35}$ can be taken together to form a nitrogen-containing ring, and mixtures thereof; X is a water soluble anion; B is a branching unit having the formula:

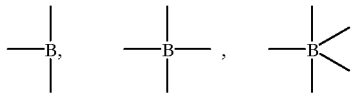

wherein B is selected from the group consisting of boron, aluminum, nitrogen, phosphorous, carbon, silicon, tin, germanium, and mixtures thereof, preferably carbon or silicon; and $L^1$ and $L^2$ are linking units, provided said linking units when taken together with said B unit comprise a total of at least 2 continuous covalent bonds from said P unit to said E units; m is from 2 to 4; and c) the balance carriers and adjunct ingredients, said adjunct ingredients are selected from the group consisting of buffers, builders, chelants, filler salts, soil release agents, dispersants, enzymes, enzyme boosters, perfumes, thickeners, abrasives, solvents, clays, and mixtures thereof.

Photosensitizing Units, P

The photosensitizers of the present invention suitable for use as photobleaches and photodisinfectants comprise cyanine rings as well as hybrid cyanine rings. The cyanine rings are those formed from four identical aromatic units, for example, phthalocyanines and naphthalocyanines. The hybrid rings are formed by chemically reacting together at least two different aromatic monomer units capable of forming a hybrid cyanine ring. Typically, cyanine rings are defined by the type of aromatic monomer unit used to synthesize the target macrocyclic ring, for example, phthalocyanines are formed from derivatives of benzene, naphthalocyanines are formed from derivatives of naphthalene, etc.

The cyanine rings of the present invention have the general formula

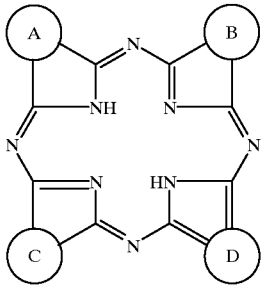

wherein A, B, C, and D represent aromatic rings. For the purposes of the present invention these aromatic rings are preferably substituted or unsubstituted benzene, 1,2-naphthalene, 2,3-naphthalene, anthracene, and phenanthrene. However, this list is not meant to be inclusive or exclusive of any other aromatic ring capable of insertion into the cyanine ring including aromatic heterocyclic rings inter alia quinolines or isoquinolines.

For the purpose of further illustrating the formation of hybrid cyanine rings useful for preparing the singlet oxygen generators of present invention, the scheme below depicts the expected mixture of cyanine rings obtained when the cyanine ring forming monomers, 1,6-dimethoxy-3,4-dicyanobenzene and 1,6-dibromo-3,4-dicyanobenzene, are reacted together under suitable conditions.

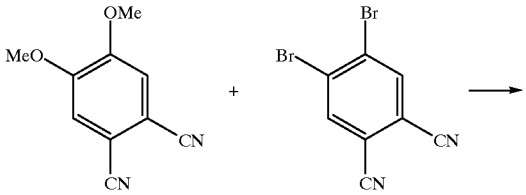

Reacted together under suitable conditions yield:

I

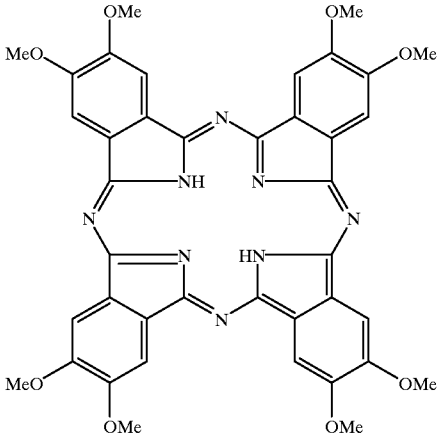

II

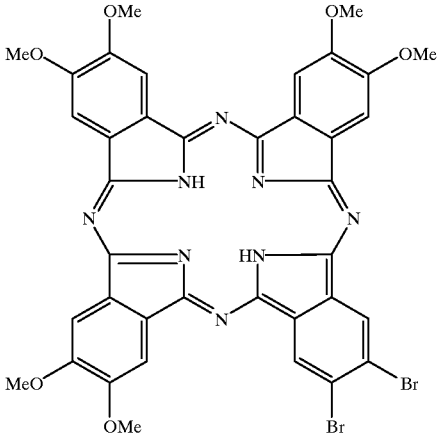

III

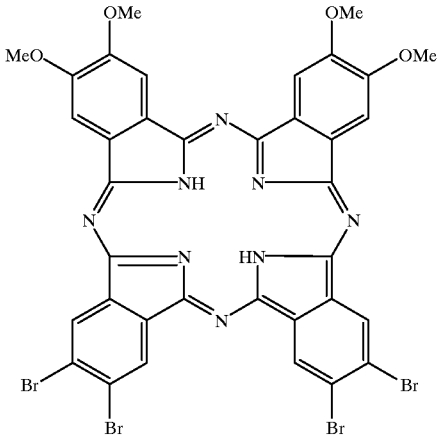

-continued
IV
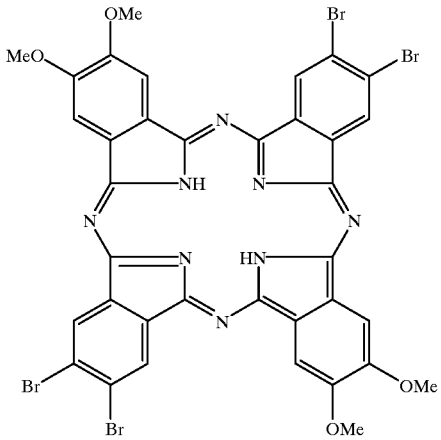
V
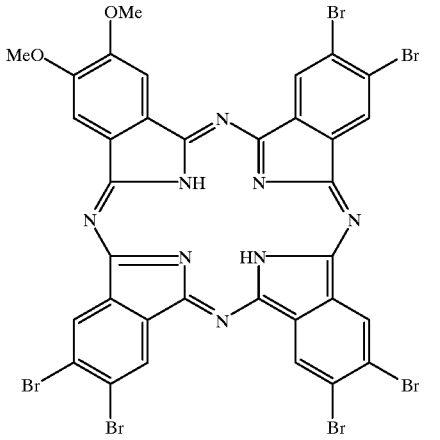
VI
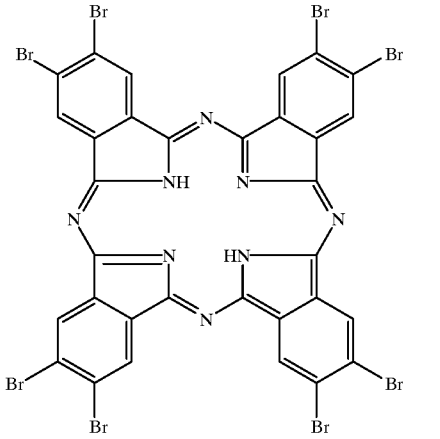
Other examples include but are not limited to the reaction of orthodicyanobenzene and 2,3-dicyanonaphthalene as shown below
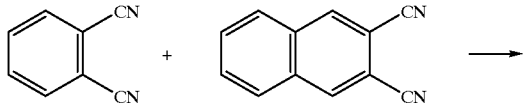
or the reaction of the corresponding phthalimidines as shown below
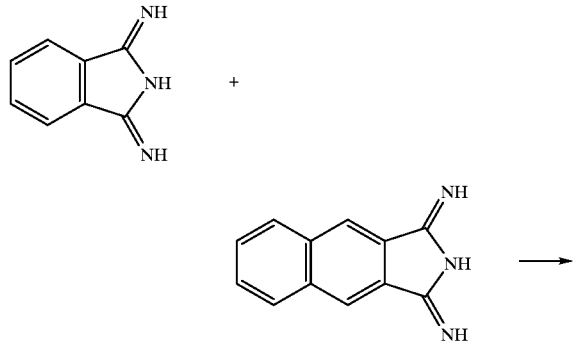
to yield the mixture of hybrid cyanines I–VI shown below.
I
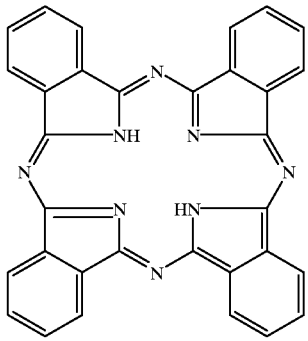
II
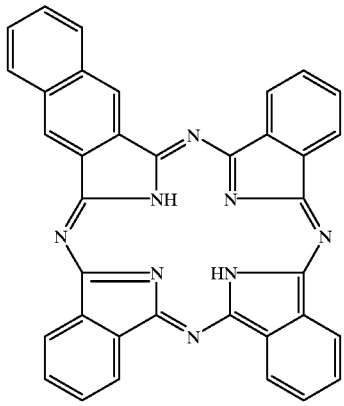
III
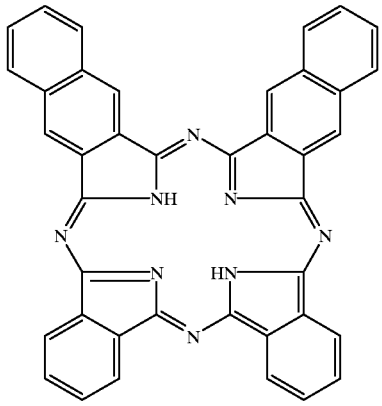

-continued

IV

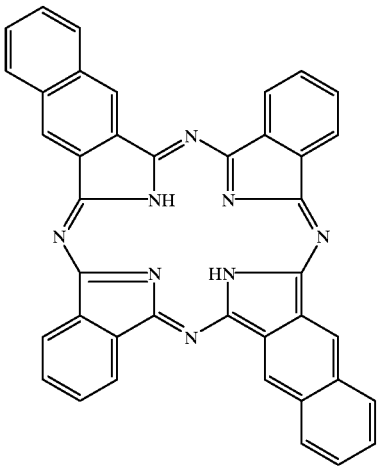

V

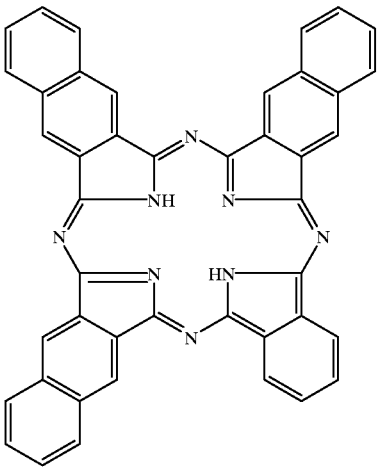

VI

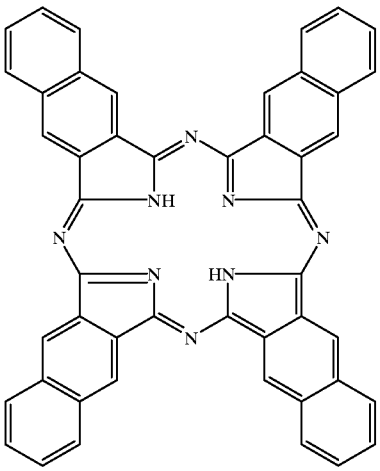

For the purposes of the present invention ring components derived from substituted and unsubstituted benzene can be written in either of two equivalent resonance formulas:

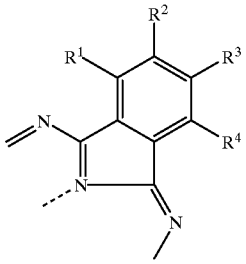

or

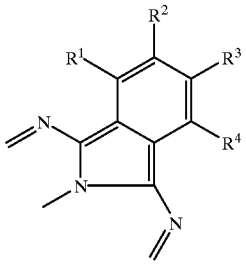

wherein $R^1$, $R^2$, $R^3$ and $R^4$ are each independently selected from the substituents described herein below.

For the purposes of the present invention ring components derived from substituted and unsubstituted 2,3-naphthylene can be written in either of two equivalent resonance formulas:

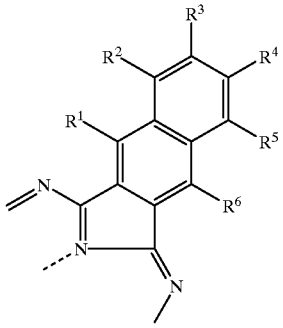

or

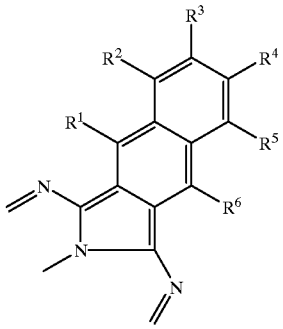

wherein $R^1$, $R^2$, $R^3$, $R^4$, $R^5$, and $R^6$ are independently selected from the substituents described herein below.

For the purposes of the present invention ring components derived from substituted and unsubstituted 1,2-naphthylene can be written in either of two equivalent resonance formulas:

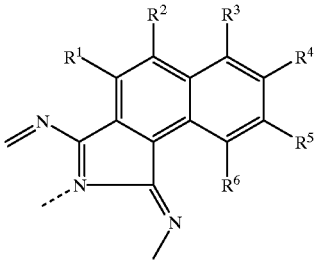

or

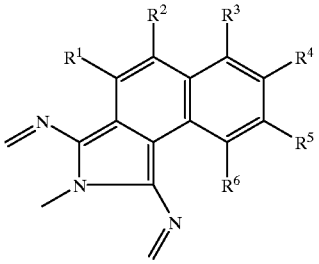

wherein $R^1$, $R^2$, $R^3$, $R^4$, $R^5$, and $R^6$ units are independently selected from the substituents listed herein below.

For the purposes of the present invention ring components derived from substituted and unsubstituted anthracene can be written in either of two equivalent resonance formulas:

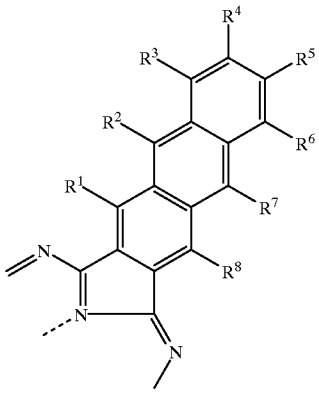

or

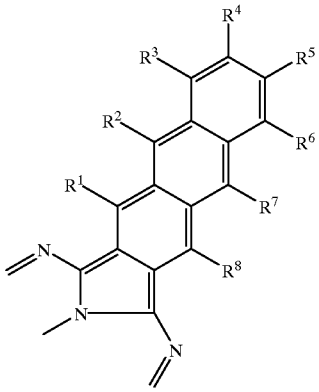

wherein $R^1$, $R^2$, $R^3$, $R^4$, $R^5$, $R^6$, $R^7$, and $R^8$ units are independently selected from the substituents described herein below.

For the purposes of the present invention ring components derived from substituted and unsubstituted phenanthrene can be written in either of two equivalent resonance formulas:

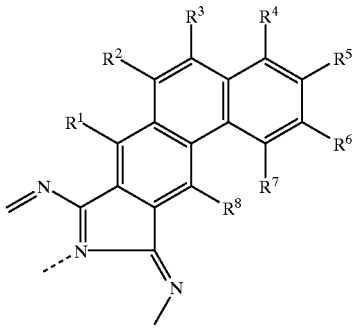

or

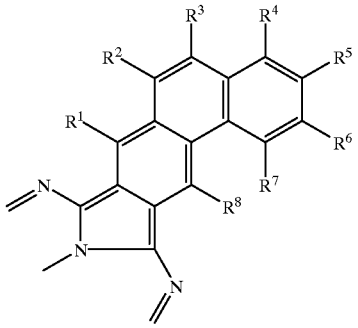

wherein $R^1$, $R^2$, $R^3$, $R^4$, $R^5$, $R^6$, $R^7$, and $R^8$ units are independently selected from the substituents described herein below.

Each $R^1$, $R^2$, $R^3$, $R^4$, $R^5$, $R^6$, $R^7$, and $R^8$ unit is independently:

a) hydrogen;

b) halogen;

c) hydroxyl;

d) $C_1$–$C_{22}$ alkyl, $C_3$–$C_{22}$ branched alkyl, $C_2$–$C_{22}$ alkenyl, $C_3$–$C_{22}$ branched alkenyl;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl;

f) polyhydroxyl substituted $C_3$–$C_{22}$ alkyl;

g) $C_1$–$C_{22}$ alkoxy, preferably $C_1$–$C_4$ alkoxy, more preferred methoxy;

h) branched alkoxy having the formula

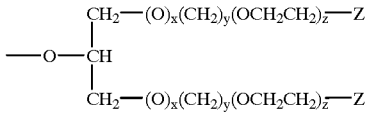

or

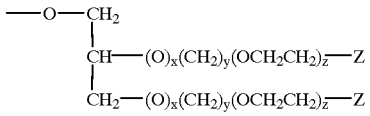

wherein Z is hydrogen, hydroxyl, $C_1$–$C_{30}$ linear alkyl, $C_1$–$C_{30}$ branched alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3;

i) substituted aryl, and unsubstituted aryl having essentially the formula:

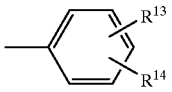

wherein $R^{13}$ and $R^{14}$ are independently selected from the group consisting of hydrogen, $C_1$–$C_6$ alkyl, $C_3$–$C_6$ alkenyl, $C_1$–$C_6$ alkoxy, $C_3$–$C_6$ branched alkoxy, halogen, $—CO_2^-M^+$, $—SO_3^-M^+$, $—OSO_3^-M^+$, $—N(R^{15})_2$, and $—N^+(R^{15})_3X^-$ wherein each $R^{15}$ is independently hydrogen or $C_1$–$C_4$ alkyl; and mixtures thereof; preferably hydrogen $C_1$–$C_6$ alkyl, $—CO_2^-M^+$, $—SO_3^-M^+$, $—OSO_3^-M^+$, and mixtures thereof, more preferably $R^{13}$ or $R^{14}$ is hydrogen and the other moiety is $C_1$–$C_6$ alkyl; wherein M is a water soluble cation and X is a water soluble anion;

j) substituted alkylenearyl and unsubstituted alkylenearyl having essentially the formula:

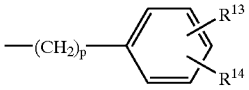

wherein $R^{13}$ and $R^{14}$ are as defined above, p is from 1 to about 10.

k) substituted aryloxy and unsubstituted aryloxy having essentially the formula:

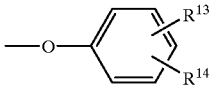

wherein $R^{13}$ and $R^{14}$ are as defined above.

l) substituted alkyleneoxyaryl and unsubstituted alkyleneoxyaryl units are defined as moieties having essentially the formula:

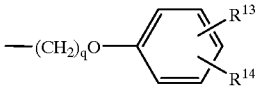

wherein $R^{13}$ and $R^{14}$ are as defined above, q is from 0 to about 10.

m) substituted oxyalkylenearyl and unsubstituted oxyalkylenearyl having essentially the formula:

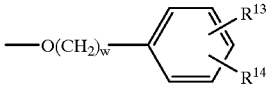

wherein $R^{13}$ and $R^{14}$ are as defined above, w is from about 1 to about 10.

n) $C_1$–$C_{22}$ linear thioalkyl, $C_3$–$C_{22}$ branched thioalkyl, $C_1$–$C_{22}$ linear substituted thioalkyl, $C_3$–$C_{22}$ branched substituted thioalkyl, and mixtures thereof;

o) ester units of the formula $—CO_2R^9$ wherein $R^9$ is $C_1$–$C_{22}$ alkyl, $C_3$–$C_{22}$ branched alkyl, $C_2$–$C_{22}$ alkenyl, $C_3$–$C_{22}$ branched alkenyl, all of which can be substituted with halogen; poly-hydroxyl substituted $C_3$–$C_{22}$ alkyl, $C_3$–$C_{22}$ glycol; $C_1$–$C_{22}$ alkoxy, $C_3$–$C_{22}$ branched alkoxy; substituted and unsubstituted aryl, alkylenearyl, aryloxy, oxyalkylenearyl, alkyleneoxyaryl; preferably $C_1$–$C_{22}$ alkyl, $C_3$–$C_{22}$ branched alkyl, and mixtures thereof;

p) alkyleneamino units having essentially the formula:

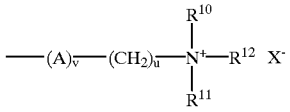

wherein $R^{10}$, and $R^{11}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{12}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, the index v is 0 or 1; A is —O— of —NH—; X is a water soluble anion, u is from 0 to 22, preferably u is from 3 to about 10, provided that if v is 1 then u is greater than or equal to 1. Examples of water soluble anions include organic species such as fumarate, tartrate, oxalate and the like, inorganic species include chloride, bromide, sulfate, hydrogen sulfate, phosphate and the like;

q) an amino unit of the formula $—NR^{17}R^{18}$ wherein $R^{17}$ and $R^{18}$ are each a $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) alkylethyleneoxy units having essentially the formula:

$—(A)_v—(CH_2)_y(OCH_2CH_2)_xZ$ wherein Z is hydrogen, hydroxyl, $—CO_2H$, $—SO_3^-M^+$, $—OSO_3^-M^+$, $C_1$–$C_6$ alkoxy, substituted and unsubstituted aryl, substituted and unsubstituted aryloxy; alkyleneamino as defined herein above; or mixtures thereof; A units comprise nitrogen or oxygen, preferably oxygen; M is a water soluble cation; v is 0 or 1; x is from 0 to 100, preferably from 0 to 20, more preferably from 0 to 5; y is from 0 to 12, preferably from 1 to 4; however, no peroxide —O—O— bonds are contained within the photobleaching compounds of the present invention;

s) siloxy and substituted siloxy of the formula $—OSiR^{19}R^{20}R^{21}$ wherein each $R^{19}$, $R^{20}$, and $R^{21}$ is independently selected from the group consisting of $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof, substituted or unsubstituted aryl, aryloxy; alkylethyleneoxy units of the formula:

$—(A)_v—(CH_2)_y(OCH_2CH_2)_xZ$ wherein Z is hydrogen, hydroxyl, $C_1$–$C_{30}$ alkyl, $—CO_2H$, $—SO_3^-M^+$, $—OSO_3^{-M+}$, $C_1$–$C_6$ alkoxy; substituted or unsubstituted aryl, and aryloxy; alkyleneamino as defined herein above, and mixtures thereof, preferably hydrogen or $C_1$–$C_6$ alkyl, more preferably methyl; v is 0 or 1; x is from 1 to 100, preferably from 0 to about 20, more preferably from 3 to about 10; and y is from 0 to 12, preferably from about 0 to about 5.

Cationic Substantivity Units, D

The photochemical singlet oxygen generators of the present invention comprise one or more "cationic substantivity" units. For the purposes of the present invention "cationic substantivity" units are defined as "units which serve to increase the ability of the photochemical singlet oxygen generator to approach the fabric surface wherein the production of singlet oxygen molecules serve to chemically modify dirt, stains, and soil to a water soluble form". Cationic Substantivity Units, have the formula:

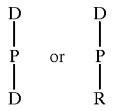

wherein P is a photosensitizer unit; R is an axial moiety which mediates the solubility of the singlet oxygen generator; and D is a unit which increases the substantivity of the singlet oxygen generator for fabric surfaces, said unit having the formula $$—L^1—E \text{ or } —L^1—B—[L^2—E]_m$$

wherein E is a unit which comprises a tetravalent nitrogen having the formula:

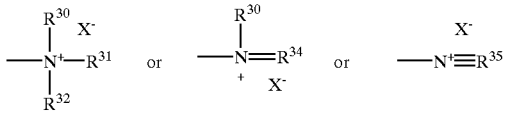

wherein each $R^{30}$–$R^{35}$ is linear and branched $C_1$–$C_{22}$ alkyl, linear and branched $C_1$–$C_{22}$ alkenyl, substituted and unsubstituted aryl, substituted and unsubstituted alkylenearyl, substituted and unsubstituted aryloxy, substituted and unsubstituted alkyleneoxyaryl, substituted and unsubstituted oxyalkylenearyl, as described herein above; or any $R^{30}$–$R^{35}$ can be taken together to form a nitrogen-containing ring.

Preferably $R^{30}$–$R^{35}$ is an alkyleneoxyalkyl having the formula:

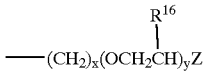

wherein $R^{16}$ is hydrogen of $C_1$–$C_4$ alkyl; Z is $C_1$–$C_{18}$ alkyl, $C_1$–$C_{20}$ alkoxy, substituted or unsubstituted aryl, —$CO_2M$, —$OCH_2CO_2M$, —$SO_3M$, and mixtures thereof; M is a water soluble cation; the index x has the value from 1 to 6, the index y has the value from 1 to 30.

X is a water soluble anion which provides charge balance for the cationic substantivity unit. X can be any water soluble unit which is compatible with the balance of the photosensitizing molecules. If more than one cationic group is present, that is more than one positive charge is present due to cationic moieties, an X unit having a negative charge equal to the number of positive charges is therefore suitable for use. For example, two positive charges may be suitably neutralized by the presence of a sulfate ($SO_4^{2-}$) unit. Non-limiting examples or X units are the water soluble anions such as chlorine ($Cl^-$), bromine ($Br^-$) and iodine ($I^-$) or X can be any negatively charged radical such as sulfate ($SO_4^{2-}$), methosulfate ($CH_3SO_3^-$), etc.

B is a branching unit having the formula:

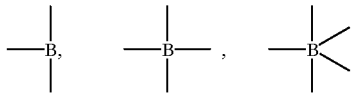

wherein B is selected from the group consisting of boron, aluminum, nitrogen, phosphorous, carbon, silicon, tin, germanium. and mixtures thereof, preferably carbon or silicon; and $L^1$ and $L^2$ are linking units; m is from 2 to 4.

Preferred $L^1$ and $L^2$ units are independently selected from the group consisting of oxygen, linear or branched alkylene, linear or branched alkenylene; linear or branched alkyleneoxy, substituted or unsubstituted arylene, substituted or unsubstituted alkylenearylene, substituted or unsubstituted aryleneoxy, substituted or unsubstituted oxyalkylenearylene, substituted or unsubstituted alkyleneoxyarylene, and mixtures thereof, defined herein further below.

For the purposes of the present invention an oxygen molecule may serve as a suitable $L^1$ unit, preferably when directly bonded to a branching unit to form a moiety having the general formula:

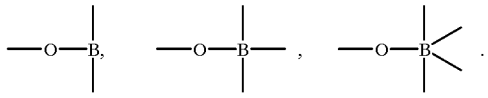

For the purposes of the present invention linear or branched alkylene moieties are defined as units having the formula:

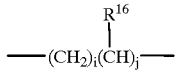

wherein $R^{16}$ is $C_1$–$C_4$ alkyl; the index i has the value from 1 to 30, the index j has the value from 1 to 30. If only one linking group $L^1$ is present between the photosensitizer unit P and the harvester unit E then the value of i+j must be at least 20.

For the purposes of the present invention linear or branched alkenylene moieties are defined as moieties comprising one or more units, or combinations of units having the formula:

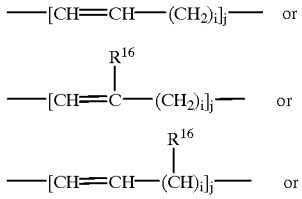

-continued

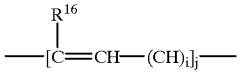

wherein $R^{16}$ is $C_1$–$C_4$ alkyl; the index i has the value from 1 to 30. In the case where only one linking group $L^1$ is present between the photosensitizer unit P and the harvester unit E then the values of i and j must be sufficient to provide at least 20 covalent bonds between said photosensitizer unit P and said harvester unit E.

For the purposes of the present invention linear or branched alkyleneoxy moieties which comprise the $L^1$ or $L^2$ units described herein below, are defined as units or a combination of units having the formula:

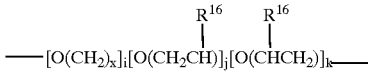

wherein $R^{16}$ is $C_1$–$C_4$ alkyl; the index x has the value from 2 to 4; whereas the values of the indices i, j and k must have sufficient value for at least 20 covalent bonds between the photosensitizer unit P and the harvester unit E.

For the purposes of the present invention substituted or unsubstituted arylene moieties are defined as 1,2-phenylene, 1,3-phenylene, and 1,4-phenylene units having essentially the formula:

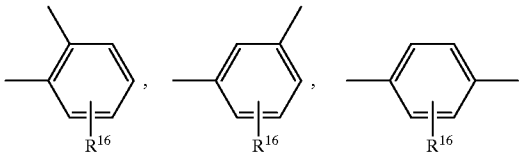

wherein $R^{16}$ is hydrogen, $C_1$–$C_4$ alkyl, and mixtures thereof. Arylene units may be used alone or in combination with other suitable moieties to form $L^1$ and $L^2$ units.

For the purposes of the present invention substituted or unsubstituted alkylenearylene moieties are defined as 1,2-phenylene, 1,3-phenylene, and 1,4-phenylene units having essentially the formula:

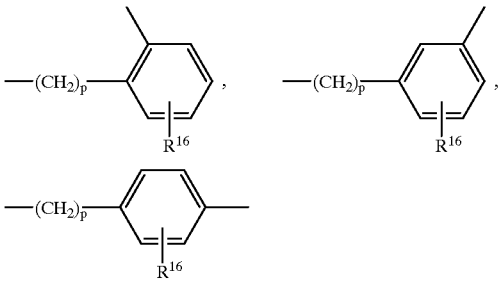

wherein $R^{16}$ is hydrogen, $C_1$–$C_4$ alkyl, and mixtures thereof alkylenearylene units may be used alone or in combination with other suitable moieties to form $L^1$ and $L^2$ units.

For the purposes of the present invention substituted and unsubstituted aryleneoxy moieties are defined as 1,2-phenyleneoxy, 1,3-phenyleneoxy, and 1,4-phenyleneoxy units having essentially the formula:

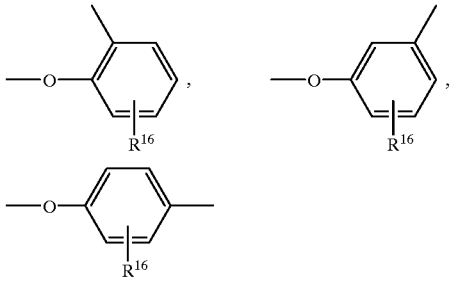

wherein $R^{16}$ is hydrogen, $C_1$–$C_4$ alkyl, and mixtures thereof. Aryleneoxy units may be used alone or in combination with other suitable moieties to form $L^1$ and $L^2$ units.

For the purposes of the present invention substituted and unsubstituted oxyalkylenearylene moieties are defined as 1,2-oxyalkylenephenylene, 1,3-oxyalkylenephenylene, and 1,4-oxyalkylenephenylene units having essentially the formula:

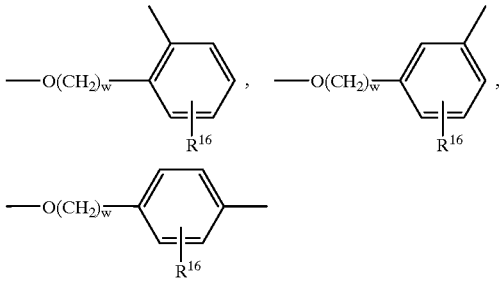

wherein $R^{16}$ is hydrogen, $C_1$–$C_4$ alkyl, and mixtures thereof, the index w has the value from 1 to 30. Oxyalkylenarylene units may be used alone or in combination with other suitable moieties to form $L^1$ and $L^2$ units.

For the purposes of the present invention substituted and unsubstituted alkyleneoxyarylene moieties are defined as 1,2-alkyleneoxyphenylene, 1,3-alkyleneoxyphenylene, and 1,4-alkyleneoxyphenylene units having essentially the formula:

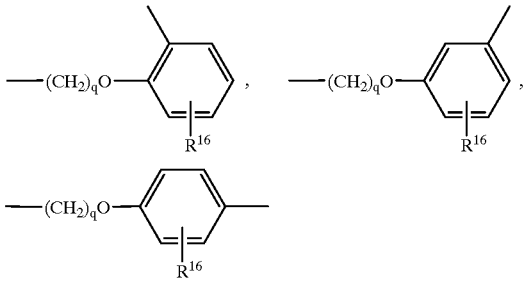

wherein $R^{16}$ is hydrogen, $C_1$–$C_4$ alkyl, and mixtures thereof, the index q has the value from 1 to 30. Alkyleneoxyarylene units may be used alone or in combination with other suitable moieties to form $L^1$ and $L^2$ units.

The D units of the present invention also optionally comprise branching units B said units essentially having the formula:

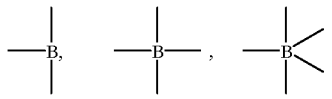

wherein B is selected from the group consisting of boron, aluminum, nitrogen, phosphorous, carbon, silicon, tin, germanium, and mixtures thereof, preferably carbon or silicon, more preferably carbon.

The following formulas are examples of suitable cationic moieties having enhanced fabric substantivity properties:

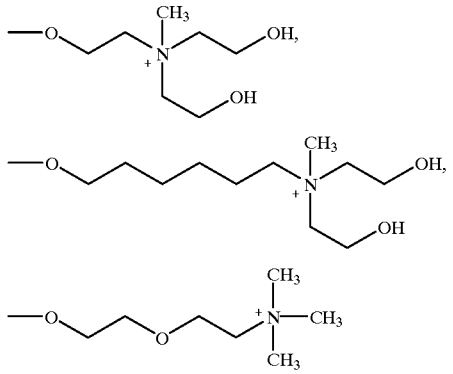

wherein these axial moieties may be combined with any suitable anionic $X^-$ unit.

Substantivity and Solubility Mediating Axial R Units

The singlet oxygen generators of the present invention optionally comprise an R unit. Substantivity and solubility mediating axial R units, are bonded directly to the photoactive metal or non-metal atom which is chelated by the photosensitizing unit and occupies a position axial to the essentially planar photosensitizing unit. The utility of each R unit is primarily directed to the solubility or substantivity properties of the compounds of the present invention. The selection of an R unit can be made, in addition to, or in lieu of, solubility requirements, and be totally directed instead to the "substantivity" or "non-substantivity" of the compound. R units are essentially nonionic, cationic, or anionic units.

For the purposes of the present invention the term "substantivity" is defined as "the ability for a molecule to bind, adhere, or have a general affinity for a surface" inter alia fabric and hard surfaces.

The axial R units suitable for use as substantivity or solubility mediation units of the present invention include:

a) hydrogen;

b) halogen;

c) hydroxyl;

d) $C_1$–$C_{22}$ alkyl, $C_3$–$C_{22}$ branched alkyl, $C_2$–$C_{22}$ alkenyl, $C_3$–$C_{22}$ branched alkenyl;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl;

f) polyhydroxyl substituted $C_3$–$C_{22}$ alkyl;

g) $C_1$–$C_{22}$ alkoxy, preferably $C_1$–$C_4$ alkoxy, more preferred methoxy;

h) branched alkoxy having the formula

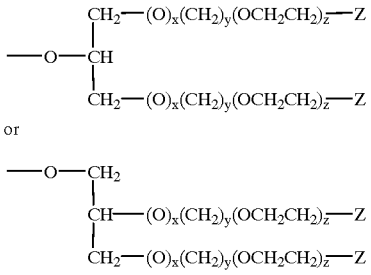

wherein Z is hydrogen, hydroxyl, $C_1$–$C_{30}$ linear alkyl, $C_1$–$C_{30}$ branched alkyl, $C_1$–$C_{30}$ alkoxy; $—CO_2H$, $—OCH_2CO_2H$, $—SO_3^-M^+$, $—OSO_3^-M^+$, $—PO_3^{2-}M$, $—OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3.

i) substituted aryl, and unsubstituted aryl having essentially the formula:

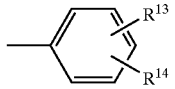

wherein $R^{13}$ and $R^{14}$ are independently selected from the group consisting of hydrogen, $C_1$–$C_6$ alkyl, $C_3$–$C_6$ alkenyl, $C_1$–$C_6$ alkoxy, $C_3$–$C_6$ branched alkoxy, halogen, $—CO_2^-M^+$, $—SO_3^-M^+$, $—OSO_3—M^+$, $—N(R^{15})_2$, and $—N^+(R^{15})_3X^-$ wherein each $R^{15}$ is independently hydrogen or $C_1$–$C_4$ alkyl; and mixtures thereof; preferably hydrogen $C_1$–$C_6$ alkyl, $—CO_2^-M^+$, $—SO_3^-M^+$, $—OSO_3^{-M+}$, and mixtures thereof, more preferably $R^{13}$ or $R^{14}$ is hydrogen and the other moiety is $C_1$–$C_6$ alkyl; wherein M is a water soluble cation and X is a water soluble anion.

j) substituted alkylenearyl and unsubstituted alkylenearyl having essentially the formula:

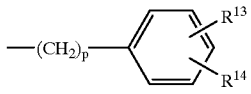

wherein $R^{13}$ and $R^{14}$ are as defined above, p is from 1 to about 10.

k) substituted aryloxy and unsubstituted aryloxy having essentially the formula:

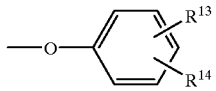

wherein $R^{13}$ and $R^{14}$ are as defined above.

l) substituted alkyleneoxyaryl and unsubstituted alkyleneoxyaryl units are defined as moieties having essentially the formula:

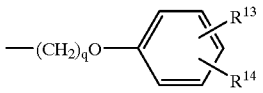

wherein $R^{13}$ and $R^{14}$ are as defined above, q is from 0 to about 10.

m) substituted oxyalkylenearyl and unsubstituted oxyalkylenearyl having essentially the formula:

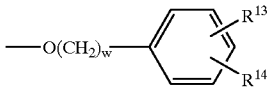

wherein $R^{13}$ and $R^{14}$ are as defined above, w is from about 1 to about 10.

n) $C_1$–$C_{22}$ linear, $C_3$–$C_{22}$ branched thioalkyl, $C_1$–$C_{22}$ linear, $C_3$–$C_{22}$ branched substituted thioalkyl, and mixtures thereof;

o) carboxylate units of the formula

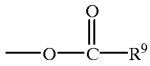

wherein $R^9$ is $C_1$–$C_{22}$ alkyl, $C_3$–$C_{22}$ branched alkyl, $C_2$–$C_{22}$ alkenyl, $C_3$–$C_{22}$ branched alkenyl, all of which can be substituted with halogen;

poly-hydroxyl substituted $C_3$–$C_{22}$ alkyl, $C_3$–$C_{22}$ glycol; $C_1$–$C_{22}$ alkoxy, $C_3$–$C_{22}$ branched alkoxy; substituted and unsubstituted aryl, alkylenearyl, aryloxy, oxyalkylenearyl, alkyleneoxyaryl; preferably $C_1$–$C_{22}$ alkyl, $C_3$14 $C_{22}$ branched alkyl, and mixtures thereof;

p) alkyleneamino units having essentially the formula:

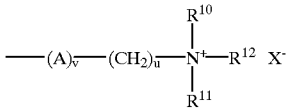

wherein $R^{10}$, and $R^{11}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{12}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, the index v is 0 or 1; X is a other water soluble anion, u is from 0 to 22, preferably u is from 3 to about 10. Examples of water soluble anions include organic species such as fumarate, tartrate, oxalate and the like, inorganic species include chloride, bromide, sulfate, hydrogen sulfate, phosphate and the like;

q) an amino unit of the formula $$—NR^{17}R^{18}$$

wherein $R^{17}$ and $R^{18}$ are each a $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) alkylethyleneoxy units having essentially the formula:

$$—(A)_v—(CH_2)_y(OCH_2CH_2)_xZ$$

wherein Z is hydrogen, hydroxyl, $—CO_2H$, $—SO_3^-M^+$, $—OSO_3^-M^+$, $C_1$–$C_6$ alkoxy, substituted and unsubstituted aryl, substituted and unsubstituted aryloxy; alkyleneamino as defined herein above; or mixtures thereof; A units comprise nitrogen or oxygen, preferably oxygen; M is a water soluble cation; v is 0 or 1; x is from 0 to 100, preferably from 0 to 20, more preferably from 0 to 5; y is from 0 to 12, preferably from 1 to 4; however, no peroxide —O—O— bonds are contained within the photobleaching compounds of the present invention;

s) siloxy and substituted siloxy of the formula $—OSiR^{19}R^{20}R^{21}$ wherein each $R^{19}$, $R^{20}$, and $R^{21}$ is independently selected from the group consisting of $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof, substituted or unsubstituted aryl, aryloxy; alkylethyleneoxy units of the formula:

$$—(A)_v—(CH_2)_y—(OCH_2CH_2)_xZ$$

wherein Z is hydrogen, hydroxyl, $C_1$–$C_{30}$ alkyl, $—CO_2H$, $—SO_3^-M^+$, $OSO_3^-M^+$, $C_1$—$C_6$ alkoxy; substituted or unsubstituted aryl, and aryloxy; alkyleneamino as defined herein above, and mixtures thereof, preferably hydrogen or $C_1$–$C_6$ alkyl, more preferably methyl; v is 0 or 1; x is from 1 to 100, preferably from 0 to about 20, more preferably from 3 to about 10; and y is from 0 to 12, preferably from about 0 to about 5.

According to the present invention the preferred axial R units comprise moieties having the formula $$—Y_i—K_j \text{ and } —Y_i—Q_j$$

wherein Y is a linking moiety selected from the group consisting of O, $CR^{25}R^{26}$, $OSiR^{25}R^{26}$, $OSnR^{25}R^{26}$, and mixtures thereof; wherein $R^{25}$ and $R^{26}$ are hydrogen, $C_1$–$C_4$ alkyl, halogen, and mixtures thereof; i is 0 or 1, j is from 1 to 3;

K is a ligand selected from the group consisting of:

a) $C_1$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl, and mixtures thereof;

b) an alkylethyleneoxy unit of the formula $$—(R^{23})_y(OR^{22})_xOZ$$

wherein Z is selected from the group consisting of hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl, and mixtures thereof; $R^{22}$ is selected from the group consisting of $C_1$–$C_4$ linear alkylene, $C_3$–$C_4$ branched alkylene, $C_3$–$C_6$ hydroxyalkylene, and mixtures thereof; $R^{23}$ is selected from the group consisting of $C_2$–$C_{20}$ alkylene, $C_3$–$C_{20}$ branched alkylene, $C_6$–$C_{20}$ arylene, $C_7$–$C_{30}$ arylalkylene, $C_7$–$C_{30}$ alkylarylene, and mixtures thereof; x is from 1 to 100; y is 0 or 1; and Q is an ionic moiety having the formula:

$$—R^{24}—W$$

wherein $R^{24}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures: thereof; W is selected from the group consisting of $—CO_2^-$ $M^+$, $—SO_3^-M^+$, $—SO_3^-M^+$; $PO_3^{2-}M^+$, $—OPO_3^-M^+$, $—N^+(R^{27})_3X^-$; wherein $R^{27}$ is independently. hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion as defined herein above.

Preferred axial R units are alkyl alkyleneoxy units of the formula $$—(R^{23})_y(OR^{22})_xOZ$$

wherein Z is selected from the group consisting of hydrogen, $C_7$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, $C_7$–$C_{20}$ arylalkyl, $C_7$–$C_{20}$ alkylaryl, and mixtures thereof; $R^{22}$ is selected from the group consisting of $C_1$–$C_4$ linear alkylene, $C_3$–$C_4$ branched alkylene, and mixtures thereof; $R^{23}$ is selected from the group consisting of $C_2$–$C_6$ alkylene, $C_3$–$C_6$ branched alkylene, $C_6$–$C_{10}$ arylene, and mixtures thereof; x is from 1 to 50; y is 0 or 1.

More preferred axial R units; comprise y equal to 0, Z is hydrogen, $C_1$–$C_{20}$ alkyl, $C_3$–$C_{20}$ branched alkyl, $C_6$–$C_{10}$ aryl, and mixtures thereof, most preferred Z is hydrogen or $C_6$–$C_{20}$ linear alkyl, $C_{10}$–$C_{20}$ branched alkyl; $R^{22}$ is $C_1$–$C_4$ linear or $C_3$–$C_4$ branched alkylene.

Also preferred R units having the formula:

$$—Y_i—Q_j$$

wherein Y is a linking moiety selected from the group consisting of O, $CR^{25}R^{26}$ $OSiR^{25}R^{26}$, $OSnR^{25}R^{26}$, and mixtures thereof; i is 0 or 1, j is from 1 to 3; Q is an ionic moiety having the formula:

$$—R^{24}—W$$

wherein $R^{24}$ is selected from the group consisting of $C_2$–$C_{20}$ linear alkylene, $C_3$–$C_{20}$ branched alkylene, $C_2$–$C_{20}$ linear alkenylene, $C_3$–$C_{20}$ branched alkenylene, $C_6$–$C_{10}$ arylene, and mixtures thereof; W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$; where independently hydrogen, $C_1$–$C_6$ alkyl, $(CH_2)_nOH$, $—(CH_2CH_2O)_nH$, and mixtures thereof; wherein n is from 1 to 4; M is a water soluble cation of sufficient charge to provide electronic neutrality and X is a water soluble anion as defined herein above.

A preferred hydrophilic R has the index i equal to 1; $R^{24}$ is $C_3$–$C_{20}$ linear alkylene, $C_3$–$C_{20}$ branched alkylene, W is $—CO_2^-M^+$, $—SO_3^-M^+$, $—OSO_3^-M^+$; M is a water soluble cation of sufficient charge to provide electronic neutrality.

Examples of Y units suitable, for use in R units having the formula:

$$—Y_i—K_j$$

have the formula $$—O—K^1,\ —Sn—K^1,\ —OSn—K^1$$

wherein i is equal to 1 and j is equal to 1. Further examples have the formula

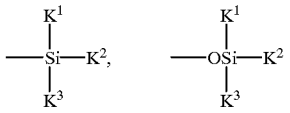

wherein i is equal to 1 and j is equal to 3. The above examples also apply to Y units when used with Q ionic moieties.

An example of a preferred photochemical singlet oxygen generator according to the present invention has the following formula:

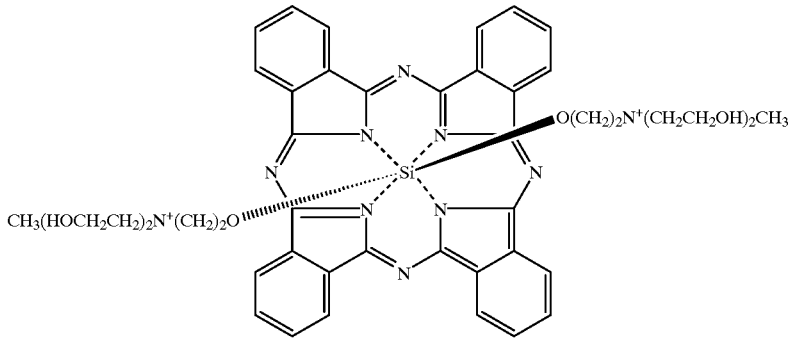

wherein the photosensitizer unit P comprises an unsubstituted silicon(IV) phthalocyanine ($R^1$–$R^4$ of each benzene ring is hydrogen) and there are two identical D cationic units wherein $L^1$ is an alkyleneoxy unit having the formula:

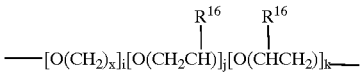

wherein the indices j and k are equal to 0, x is equal to 2, and i is equal to 1, and the E is has the formula wherein $R^{30}$ and $R^{31}$ are each hydroxyethyl and $R^{32}$ is methyl, $X^-$ is any suitable water soluble anion.

Further examples of photochemical singlet oxygen generators according to the present invention are the silicon(IV) phthalocyanines having the general formula:

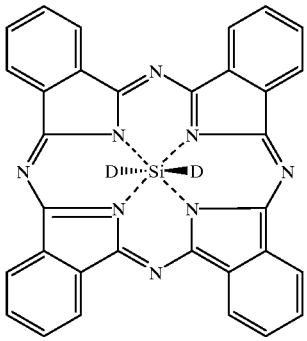

wherein for the first example each D, unit has the formula:

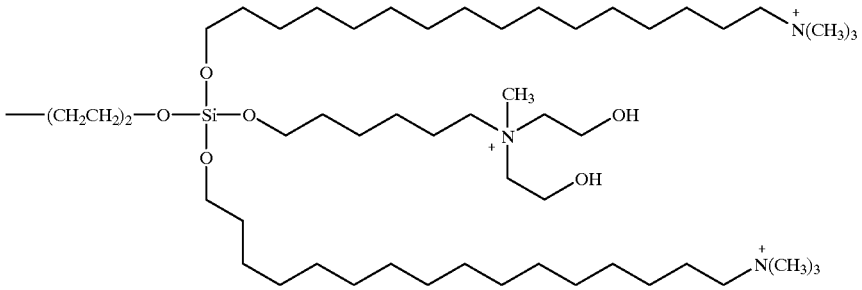

wherein $L^1$ is and alkyleneoxy unit wherein the indices j and k are each equal to 0; x is equal to 2 and i is equal to 2; B is a silicon atom providing three branching points; a first pair of $L^2$ units which are alkyleneoxy units wherein the indices j and k are each equal to 0; x is equal to 17, and i is equal to 1 wherein each $L^2$ unit is connected to an E moiety wherein each $R^{30}$–$R^{32}$ are methyl; the remaining $L^2$ unit is an alkyleneoxy unit wherein j and k are each equal to 0; x is equal to 6, and i is equal to 1 wherein the $L^2$ moiety connects an E unit wherein $R^{30}$ and $R^{31}$ are each hydroxyethyl and $R^{32}$ is methyl; $X^-$ is any suitable water soluble anion.

The present invention also relates to laundry detergent compositions comprising:

a) at least about 0.001% by weight, of a detersive surfactant, said detersive surfactant selected from the group consisting of anionic, cationic, zwitterionic, nonionic, and ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a source of singlet oxygen having the formula

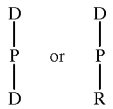

wherein P is a photosensitizing group; each D is independently a moiety which is capable of enhancing the production of singlet oxygen; and R is an axial moiety which mediates the solubility or substantivity of the singlet oxygen generator as described herein above; and c) the balance carriers and adjunct ingredients.

Preferably the laundry detergent compositions of the present invention comprise from about 0.1% to about 30% by weight, preferably from about 1% to about 30% by weight, more preferably from about 5% to about 20% by weight, of detersive surfactant.

The laundry detergent compositions of the present invention may be liquid, granular or semi-solid, for example a gel, paste, or viscous cream.

The present invention also relates to a method for cleaning a stained fabric comprising contacting a stained fabric in need of cleaning with an aqueous cleaning solution comprising at least 0.001% of the singlet oxygen generator according to the present invention followed by exposing the surface of the treated fabric to a source of light having a minimal wavelength range from about 300 to about 1200 nanometers.

Surfactant—The instant singlet oxygen generator containing compositions comprise from about 0.001% to about 60% by weight of a surfactant selected from the group consisting of anionic, nonionic, ampholytic and zwitterionic surface active agents. For liquid systems, surfactant is preferably present to the extent of from about 0.1% to 20% by weight of the composition, For solid (i.e. granular) and viscous semi-solid (i.e. gelatinous, pastes, etc.) systems, surfactant is preferably present to the extent of from about 1.5% to 30% by weight of the composition.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are described further herein and are listed in standard texts.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols (C8–18 carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil sodium or potassium salts of fatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates, such as those illustrated above, have the general formula ROSO3–M+ wherein R is typically a linear C8–22 hydrocarbyl group and M is a water solublizing cation. Branched chain primary alkyl sulfate surfactants (i.e., branched-chain "PAS") having 8–20 carbon atoms are also know; see, for example, Eur. Pat. Appl. 439,316, Smith et al., filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 of greater and the sum of m+n is typically about 9 to 17, and M is a water-solublizing cation.

The aforementioned secondary alkyl sulfates are those prepared by the addition of $H_2SO_4$ to olefins. A typical synthesis using alpha olefins and sulfuric acid is disclosed in U.S. Pat. No. 3,234,258, Morris, issued Feb. 8, 1966 or in U.S. Pat. No. 5,075,041, Lutz, issued Dec. 24, 1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3-sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

ADJUNCT MATERIALS

The following are non-limiting examples of adjunct ingredients suitable for use in either laundry or hard surface cleaning or disinfecting compositions according to the present invention.

Chelating Agents—The photo disinfectant compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that certain chelating agents will interact with photodisinfectants of the present invention to increase their absorbency in the visible light spectrum. This is a process that is due to the ability of chelating agents to help effect the "substantiveness" of the compounds of the present invention.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Inert Salts. The inert salts (filler salts) used in the compositions of the present invention can be any water-soluble inorganic or organic salt or mixtures of such salts which do not destabilize any surfactant present. For the purposed of the present invention, "water-soluble" means having a solubility in water of at least 1 gram per 100 grams of water at 20° C. Examples of suitable salts include various alkali metal and/or alkali earth metal sulfate, chlorides, borates, bromides, fluorides, phosphates, carbonates, bicarbonates, citrates, acetates, lactates, etc.

Specific examples of suitable salts include sodium sulfate, sodium chloride, potassium chloride, sodium carbonate, potassium sulfate, lithium chloride, lithium sulfate, tripotassium phosphate, sodium borate. potassium bromide, potassium fluoride, sodium bicarbonate, magnesium sulfate, magnesium chloride, sodium citrate, sodium acetate, magnesium lactate, sodium fluoride. The preferred salts are inorganic salts preferably the alkali metal sulfates and chlorides. Particularly preferred salts, because of their low cost are sodium sulfate and sodium chloride. The salts are present in the compositions at levels of from 0% to 40%. preferably 10% to 20%.

EXAMPLE 1

Preparation of Silicon Phthalocyanine Dichloride

To a mixture of 1,3-diiminoisoindoline (0.333 gm, 2.3 mmole) and anhydrous quinoline (15 mL) under argon blanketing is added silicon tetrachloride (1.1 g, 6.5 mmole). The mixture is lowered into an oil bath at 60° C. for 0.5 hr, heated to reflux over 0.5 hr, stirred at reflux for an additional 0.5 hr and cooled over 1 hr. To this solution is added methanol (10 mL) and the resultant mixture is allowed to stand at room temperature for 24 hr. The blue solid which forms upon standing is filtered off, rinsed twice with 10 mL portions of methanol, dried under vacuum at 120° C. and used without further purification.

The above procedure is suitable for use in preparing silicon naphthalocyanine dichloride using 1,3-diiminobenz-[f]-isoindoline.

EXAMPLE 2

Preparation of 1:3 Silicon(VI)phthalo/naphthalocyanine Dichloride

To a mixture of 1,3-diiminoisoindoline (0.333 gm, 2.3 mmole), 1,3-diiminobenz[f]-isoindoline (1.35 gm, 6.9 mmole) and anhydrous quinoline (15 mL) under argon blanketing is added silicon tetrachloride (2.21 g, 12.9 mmole). The mixture is lowered into an oil bath at 60° C. for 0.5 hr, heated to reflux over 0.5 hr, stirred at reflux 0.5 hr and cooled over 1 hr. To this solution is added methanol (10 mL) and the resultant mixture is allowed stand at room temperature for 24 hr. The green solid which forms is removed by filtration, rinsed twice with 10 mL portions of methanol, dried under vacuum at 120° C. and used without further purification.

EXAMPLE 3

Preparation of Silicon Phthalocyanine Dihydroxide

Silicon (IV) phthalocyanine dichloride (2 gm, 3.3 mmole) is added to a refluxing solution of sodium methoxide (0.8 g, 14.8 mmole) in 95% wet ethanol (15 mL). The reaction mixture is refluxed 4 hr then cooled to room temperature. The resulting product is collected by filtration, rinsed with water and used without subsequent purification.

The above procedure is suitable for use in preparing silicon naphthalocyanine dihydroxide, and 1:3 silicon (IV) phthalo/naphthalocyanine dihydroxide.

EXAMPLE 4

Preparation of Dilithium Naphthalocyanine

To a refluxing solution of 2,3-dicyanonaphthalene (10 gm, 56.1 mmole) in anhydrous 1-butanol (300 mL) is added lithium shot (1.56 gm, 224.5 mmole). The solution is refluxed 6 hr under a blanket of argon after which time the solution is cooled, diluted with absolute methanol (500 mL) and allowed to stand at 0° C. for 18 hr. The green solid which results is collected by filtration, dried under vacuum at 80° C. and used without further purification.

The above procedure is suitable for use in preparing 1,4,8,11,15,18,22,25-octabutoxy-29,31-dilithium phthalocyanine from 3,6-dibutoxyphthalonitrile; 2,3,9,10,16,17,23,24-octachloro-29-31-dilithium phthalocyanine from 4,5-dichlorophthalonitrile; and tetrabutoxy-29,31-dilithium phthalocyanine from 3-butoxyphthalonitrile wherein there is a mixture of isomers.

EXAMPLE 5

Preparation of Naphthalocyanine

To a solution of dilithium naphthalocyanine (2 gm, 2.75 mmole) in N,N-Dimethylformamide (200 mL) is added 1N hydrochloric acid (10 mL). The solution is stirred at room temperature for 1 hr. To this solution is added distilled water (200 mL) over approximately 0.5 hr. The green solid which forms is collected by filtration, dried under vacuum at 100° C. and used without further purification.

The above procedure is suitable for use in preparing 1,4,8,11,15,18,22,25-octabutoxy-29H,31H-phthalocyanine; 2,3,9,10,16,17,23,24-octachloro-29H,31H-phthalocyanine; and tetrabutoxy-29H,31H-phthalocyanine.

EXAMPLE 6

Preparation of Silicon Phthalocyanine-di-[methyltri (2-hydroxyethyl)ammonium Sulphate]

Silicon phthalocyanine dihydroxide (0.25 gm, 0.44 mmole), anhydrous triethanolamine (10 gm, 67 mmole) and xylenes (175 mL) are combined and heated to reflux over 1.5 hr. The solution is continued at reflux for 2 hr. while water is removed by azeotropic distillation. The reaction solution is cooled and the solvent removed in vacuo. The resulting crude oil is dissolved in DMF (50 mL) and is added to water (800 mL) over about 0.5 hr. The blue solid which forms is collected by filtration, dried under vacuum at 80° C. The solid is then slurried with dimethyl sulfate (0.15 gm, 1.22 mmole) in anhydrous pioxane (100 mL) for 18 hr at room temperature. The blue solid which forms is collected by filtration, dried, and used without further purification.

The above procedure is suitable for use in preparing silicon naphthalocyanine-di-[methyltri(2-hydroxyethyl) ammonium sulphate] and 1:3 silicon(VI)phthalo/naphthalocyanine-di-[methyltri(2-hydroxyethyl)ammonium sulphate]. The cleaning compositions provided in accordance with this invention may be in the form of granules, liquids, bars, and the like, and typically are formulated to provide an in-use pH in the range of 9 to 11, however in the case of non-aqueous or low aqueous compositions the pH ranges may vary outside this range. Various carriers such as sodium sulfate, water, water-ethanol, BPP, MPP, EPP, PPP, sodium carbonate, and the like, may be used routinely to formulate the finished products. Granules may be produced by spray-drying or by agglomeration, using known techniques, to provide products in the density range of 350–950 g/l. Bars may be formulated using conventional extrusion techniques. The compositions may also contain conventional perfumes, bactericides, hydrotropes and the like. In the case of non-aqueous or low aqueous compositions, the cleaning compositions may be applied to an article which is used to deliver the compositions of the present invention to a fabric or to a hard surface. Non-limiting examples of compositions according to this invention are as follows:

| Ingredients | weight % | | | |
|---|---|---|---|---|
| | 7 | 8 | 9 | 10 |
| Sodium LAS | 15 | 30 | 20 | 25 |
| NEODOL | 1 | 1 | 1 | 1 |
| Alkyl Dimethyl Ammonium Chloride | 0.5 | 1 | 0.5 | 0.7 |
| Sodium Tripolyphosphate | 15 | 35 | 22 | 28 |
| Sodium Carbonate | 10 | 10 | 15 | 15 |
| SOKALAN | 2 | 2 | 2 | 2 |
| Carboxymethyl Cellulose | 1 | 1 | 1 | 1 |
| Tinopal CBS-X | 0.1 | 0.1 | 0.1 | 0.1 |
| Soil Release Agent[1] | 0.2 | 0.2 | 0.3 | 0.3 |
| Savinase 6.0T | 0.3 | 0.6 | 0.5 | 0.6 |
| BAN 300T | 0.2 | 0.5 | 0.5 | 0.6 |
| Lipolase 100T | 0.1 | 0.2 | 0.2 | 0.3 |
| CAREZYME 5T | 0.1 | 0.2 | 0.2 | 0.3 |
| Sodium Perborate | — | — | 3.0 | 5.0 |
| NOBS | — | — | 2.0 | 3.0 |
| Photobleach[2] (ppm) | 0.005 | 0.01 | 0.008 | 0.01 |
| Moisture + Sodium Sulfate + Perfume + Miscellaneous | Balance | Balance | Balance | Balance |

[1]Soil Release Agent according to U.S. Pat. No. 5,415,807 Gosselink et al., issued May 16, 1995.
[2]Photobleach according to Example 6.

What is claimed is:

1. A singlet oxygen generator having the formula:

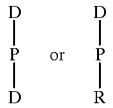

wherein P is a photosensitizer unit having the formula:

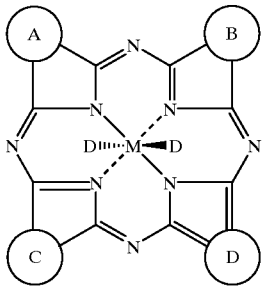

or the formula:

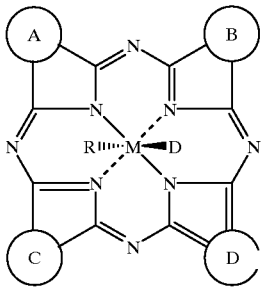

wherein M is a photoactive metal or non-metal having a valence greater than 3, rings A, B, C, and D are aromatic rings, each of said rings independently selected from the group consisting of benzene, 1,2-naphthalene, 2,3-naphthalene, anthracene, phenanthrene, and mixtures thereof;

R is an axial moiety which mediates the solubility of the singlet oxygen generator; and D is a unit which increases the fabric substantivity of the singlet oxygen generator, said unit having the formula:

$$—L^1—E \text{ or } —L^1—B—[L^2—E]_m$$

wherein E is a unit which comprises a tetravalent nitrogen having the formula:

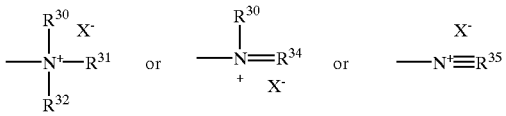

wherein each $R^{30}$–$R^{35}$ is linear $C_1$–$C_{22}$ alkyl branched $C_3$–$C_{22}$ alkyl, linear $C_1$–$C_{22}$ alkenyl, branched $C_3$–$C_{22}$ alkenyl, substituted aryl, unsubstituted aryl, substituted alkylenearyl, unsubstituted alkylenearyl, substituted aryloxy, unsubstituted aryloxy, substituted alkyleneoxyaryl, unsubstituted alkyleneoxyaryl, substituted oxyalkylenearyl, unsubstituted oxyalkylenearyl, oxyalkyl or any $R^{30}$–$R^{35}$ can be taken together to form a nitrogen-containing ring, and mixtures thereof; X is a water soluble anion;

B is a branching unit having the formula:

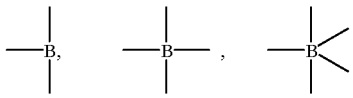

wherein B is selected from the group consisting of boron, aluminum, nitrogen, phosphorous, carbon, silicon, tin, germanium, and mixtures thereof, preferably carbon or silicon; and $L^1$ and $L^2$ are linking units independently selected from the group consisting of oxygen, linear or branched alkyl, linear of branched alkenyl, linear or branched alkyloxy, substituted or unsubstituted aryl, substituted or unsubstituted alkylaryl, substituted or unsubstituted alkyloxyaryl, substituted or unsubstituted oxyalkylaryl, and mixtures thereof, provided said linking units when taken together with said B unit comprise a total of at least 2 continuous covalent bonds from said P unit to said E units; m is from 2 to 4.

2. A compound according to claim 1 wherein rings A, B, C, and D are each independently:

i) a benzene ring unit having the formula:

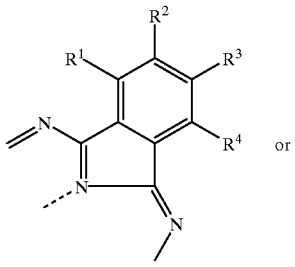

-continued
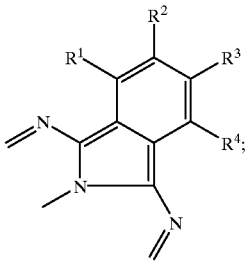
ii) a 2,3-naphthylene ring unit having the formula:
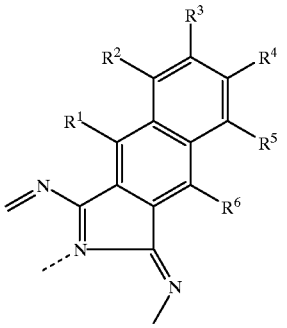
or
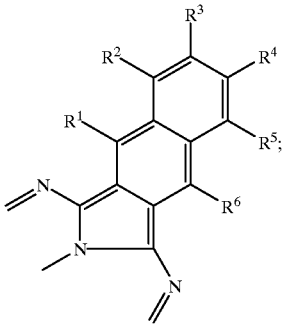
iii) a 1,2-naphthylene ring unit having the formula:
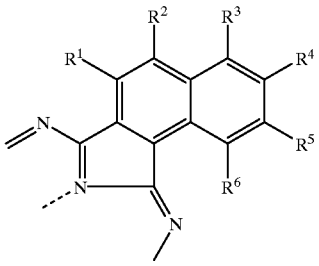
or
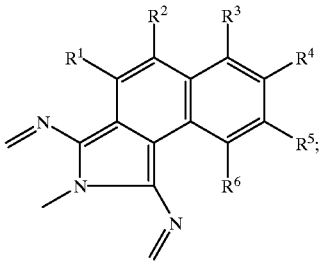
iv) an anthracene ring unit having the formula:
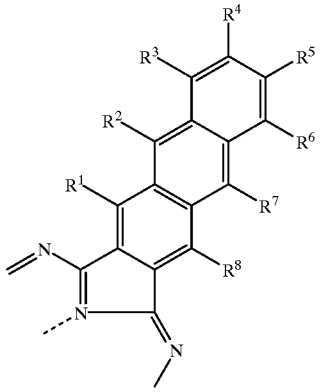
or
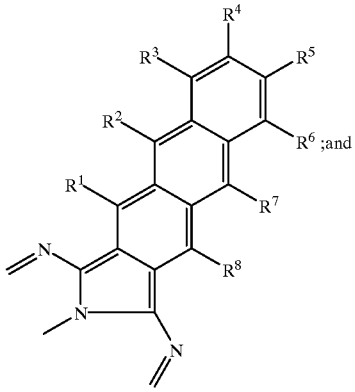
v) an phenanthrene ring unit having the formula:
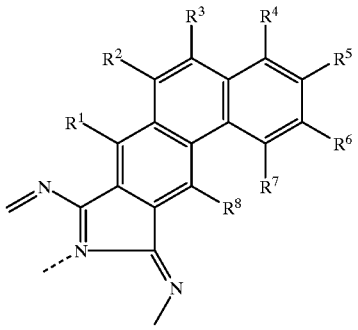
or
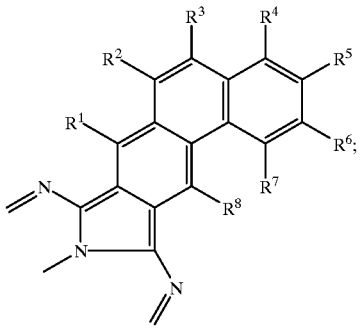
wherein each $R^1$, $R^2$, $R^3$, $R^4$, $R^5$, $R^6$, $R^7$, and $R^8$ unit is independently selected from the group consisting of:
a) hydrogen;
b) halogen;
c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

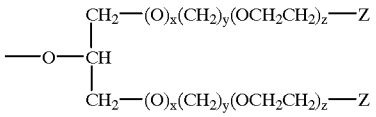

or

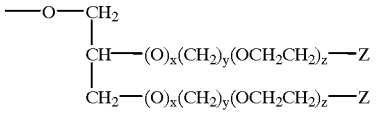

wherein Z is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, $PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures thereof;

l) substituted oxyalkylenearyl, unsubstituted oxyalkylenearyl, or mixtures thereof;

m) substituted alkyleneoxyaryl, unsubstituted alkyleneoxyaryl, or mixtures thereof;

n) $C_1$–$C_{22}$ thioalkyl, $C_3$–$C_{22}$ branched thioalkyl, or mixtures thereof;

o) an ester of the formula —$CO_2R^9$ wherein $R^9$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

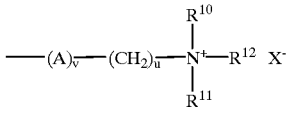

wherein $R^{10}$ and $R^{11}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) —$CO_2H$;

iv) —$SO_3^-M^+$;

v) —$OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

s) substituted siloxy of the formula:

$$—OSiR^{19}R^{20}R^{21}$$

wherein each $R^{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ$$

wherein Z is:

a) hydrogen;

b) hydroxyl;

c) —$CO_2H$;

d) —$SO_3^-M^+$;

e) —$OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to 12;

and mixtures thereof.

3. A compound according to claim 2 wherein said photoactive metal or non-metal is selected from the group consisting of silicon, phosphorous, palladium, platinum, lead, germanium, tin, and mixtures thereof.

4. A compound according to claim 1 wherein the substantivity or solubility mediating unit R is:

a) hydrogen;

b) halogen;

c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

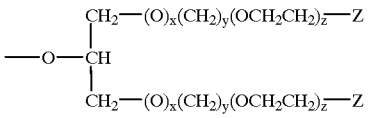

or

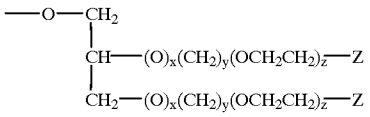

wherein Z is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures thereof;

l) substituted oxyalkylenearyl, unsubstituted oxyalkylenearyl, or mixtures thereof;

m) substituted alkyleneoxyaryl, unsubstituted alkyleneoxyaryl, or mixtures thereof;

n) $C_1C_{22}$ thioalkyl, $C_3$–$C_{22}$ branched thioalkyl, or mixtures thereof;

o) a carboxylate of the formula:

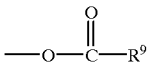

wherein $R^9$ is:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

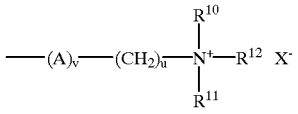

wherein $R^{10}$ and $R^{11}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) —$CO_2H$;

iv) —$SO_3^-M^+$;

v) —$OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

s) substituted siloxy of the formula:

$$—OSiR^{19}R^{20}R^{21}$$

wherein each $R^{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to 12;

and mixtures thereof.

5. A method for cleaning a stained fabric comprising contacting a stained fabric in need of cleaning with an aqueous cleaning solution comprising at least 0.001 ppm of the singlet oxygen generator according to claim 1 followed by exposing the surface of the treated fabric to a source of light having a minimal wavelength range from 300 to 1200 nanometers.

6. A compound according to claim 1 wherein $R^{30}$–$R^{35}$ is an alkyleneoxyalkyl having the formula:

$$—(CH_2)_x(OCH_2\overset{R^{16}}{\overset{|}{C}}H)_yZ$$

wherein $R^{16}$ is hydrogen of $C_1$–$C_4$ alkyl; Z is $C_1$–$C_{18}$ alkyl, $C_1$–$C_{20}$ alkoxy, substituted or unsubstituted aryl, $—CO_2M$, $—OCH_2CO_2M$, $—SO_3M$, and mixtures thereof; M is a water soluble cation; the index x has the value from 1 to 6, the index y has the value from 1 to 30.

7. A method for generating singlet oxygen comprising exposing a singlet oxygen generator according to claim 1 to a source of light having a minimal wavelength of from about 300 to about 1200 nanometers.

8. A laundry detergent composition comprising:

a) at least about 0.1%, by weight, of a detersive surfactant, said detersive surfactant is selected from the group consisting of anionic, cationic, nonionic, zwitterionic, ampholytic surfactants, and mixtures thereof;

b) at least about 0.001 ppm, of a singlet oxygen generator having the formula:

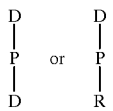

wherein P is a photosensitizer unit having the formula:

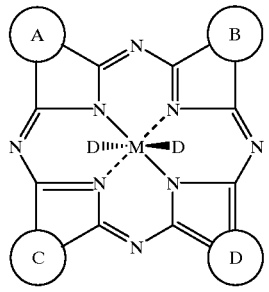

or the formula:

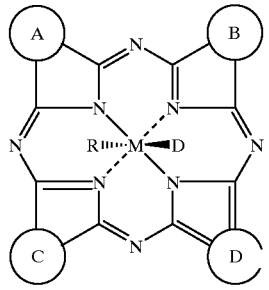

wherein M is a photoactive metal or non-metal having a valence greater than 3, rings A, B, C, and D are aromatic rings, each of said rings independently selected from the group consisting of benzene, 1,2-naphthalene, 2,3-naphthalene, anthracene, phenanthrene, and mixtures thereof;

R is an axial moiety which mediates the solubility of the singlet oxygen generator; and D is a unit which increases the fabric substantivity of the singlet oxygen generator, said unit having the formula:

$$—L^1—E \text{ or } —L^1—B—[L^2—E]_m$$

wherein E is a unit which comprises a tetravalent nitrogen having the formula:

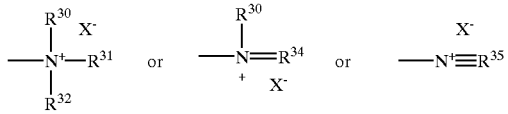

wherein each $R^{30}$–$R^{35}$ is linear and branched $C_1$–$C_{22}$ alkyl, linear and branched $C_1$–$C_{22}$ alkenyl, substituted and unsubstituted aryl, substituted and unsubstituted alkylenearyl, substituted and unsubstituted aryloxy, substituted and unsubstituted alkyleneoxyaryl, substituted and unsubstituted oxyalkylenearyl, alkyleneoxyalkyl, or any $R^{30}$–$R^{35}$ can be taken together to form a nitrogen-containing ring, and mixtures thereof; X is a water soluble anion; B is a branching unit having the formula:

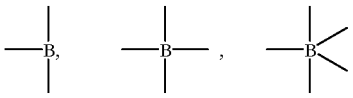

wherein B is selected from the group consisting of boron, aluminum, nitrogen, phosphorous, carbon, silicon, tin, germanium, and mixtures thereof, preferably carbon or silicon; and $L^1$ and $L^2$ are linking units, provided said linking units when taken together with said B unit comprise a total of at least 20 continuous covalent bonds from said P unit to said E units; m is from 2 to 4; and c) the balance carriers and adjunct ingredients, adjunct ingredients are selected from the group consisting of buffers, builders, chelants, filler salts, soil release agents, dispersants, enzymes, enzyme boosters, perfumes, thickeners, solvents, clays, and mixtures thereof.

9. A composition according to claim 8 wherein M is a photoactive metal or non-metal having a valence greater than 3, said metal or non-metal selected from the group consisting of platinum, palladium, silicon, tin, germanium, phosphorous, lead, and mixtures thereof; aromatic rings A, B, C, and D are aromatic rings each ring independently:

i) a benzene ring unit having the formula:

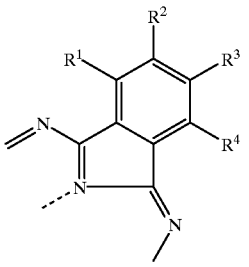

or

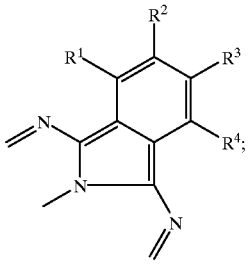

ii) a 2,3-naphthylene ring unit having the formula:

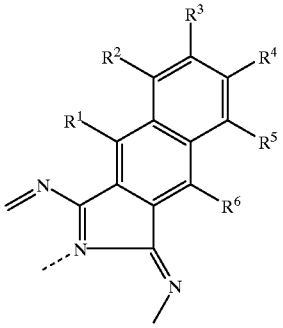

or

-continued

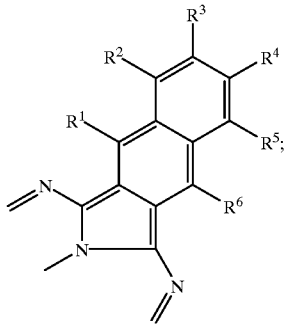

iii) a 1,2-naphthylene ring unit having the formula:

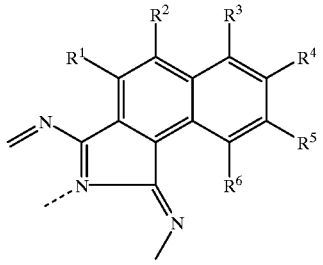

or

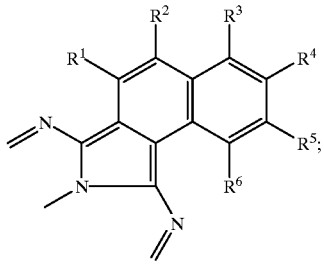

iv) an anthracene ring unit having the formula:

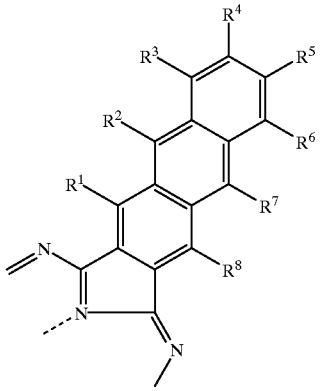

or

-continued

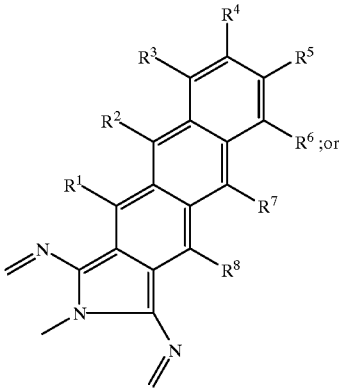

v) an phenanthrene ring unit having the formula:

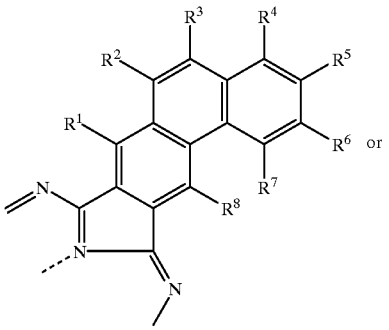

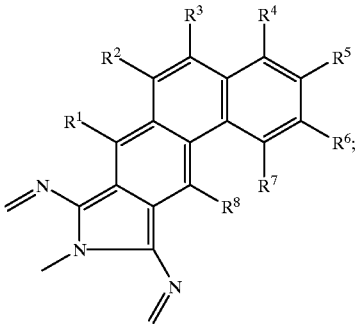

wherein each $R^1$, $R^2$, $R^3$, $R^4$, $R^5$, $R^6$, $R^7$, and $R^8$ unit is independently selected from the group consisting of:

a) hydrogen;

b) halogen;

c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

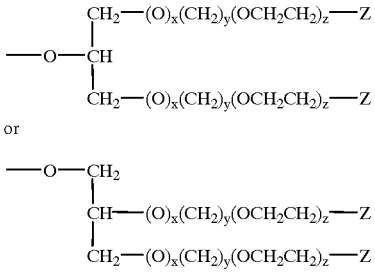

wherein Z is hydrogen, hydroxyl, $C_1$–$C_{30}$ alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures thereof;

l) substituted oxyalkylenearyl, unsubstituted oxyalkylenearyl, or mixtures thereof;

m) substituted alkyleneoxyaryl, unsubstituted alkyleneoxyaryl, or mixtures thereof;

n) $C_1$–$C_{22}$ thioalkyl, $C_3$–$C_{22}$ branched thioalkyl, or mixtures thereof;

o) an ester of the formula —$CO_2R^9$ wherein $R^9$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

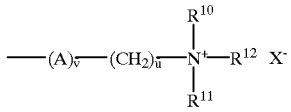

wherein $R^{10}$ and $R^{11}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

s) substituted siloxy of the formula:

$$—OSiR^{19}R^{20}R^{21}$$

wherein each $R^{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to 12; and mixtures thereof; and B) optionally substantivity or solubility mediating axial R moieties; said R moiety is:

a) hydrogen;

b) halogen;

c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

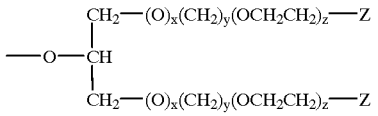

or

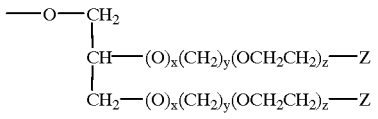

wherein Z is hydrogen, hydroxyl, $C_1$–$C_{30}$ alkyl, $C_1$–$C_{30}$ alkoxy, $—CO_2H$, $—OCH_2CO_2H$, $—SO_3^-M^+$, $—OSO_3^-M^+$, $—PO_3^{2-}M$, $—OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures l) substituted oxyalkylenearyl, unsubstituted oxyalkylenearyl, or mixtures thereof;

m) substituted alkyleneoxyarylii, unsubstituted alkyleneoxyaryl, or mixtures thereof;

n) $C_1$–$C_{22}$ thioalkyl, $C_3$–$C_{22}$ branched thioalkyl, or mixtures thereof;

o) a carboxylate of the formula:

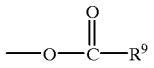

wherein $R^9$ is:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

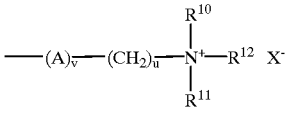

wherein $R^{10}$ and $R^{11}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

s) substituted siloxy of the formula:

$$—OSiR^{19}R^{20}R^{21}$$

wherein each $R^{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to and mixtures thereof.

10. A composition according to claim 8 wherein the detersive surfactant is present in an amount of from about 0.1% to about 30%, by weight, of the composition.

11. A composition according to claim 8 wherein the detersive surfactant is present in an amount of from about 1% to about 30%, by weight, of the composition.

12. A composition according to claim 8 wherein the detersive surfactant is present in an amount of from about 5% to about 20%, by weight, of the composition.

13. A composition according to claim 8 wherein the singlet oxygen generator is present in an amount of from about 0.01 to about 10,000 ppm.

14. A composition according to claim 8 wherein the singlet oxygen generator is present in an amount of from about 0.1 to about 5,000 ppm.

15. A composition according to claim 8 wherein the singlet oxygen generator is present in an amount of from about 10 to about 1,000 ppm.

16. A composition according to claim 8 wherein $R^{30}$–$R^{35}$ is an alkyleneoxyalkyl having the formula:

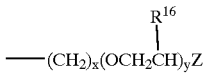

wherein $R^{16}$ is hydrogen of C1–C4 alkyl; Z is C1–C18 alkyl, C1–C20 alkoxy, substituted or unsubstituted aryl, $—CO_2M$, $—OCH_2CO_2M$, $—SO_3M$, and mixtures thereof; M is a water soluble cation; the index x has the value from 1 to 6, the index y has the value from 1 to 30.

* * * * *